United States Patent [19]

Auth

[11] Patent Number: 4,528,962

[45] Date of Patent: Jul. 16, 1985

[54] METHOD AND APPARATUS FOR LAMBDA REGULATION IN AN INTERNAL COMBUSTION ENGINE

[75] Inventor: Werner Auth, Stuttgart, Fed. Rep. of Germany

[73] Assignee: Robert Bosch GmbH, Stuttgart, Fed. Rep. of Germany

[21] Appl. No.: 644,141

[22] Filed: Aug. 24, 1984

Related U.S. Application Data

[63] Continuation of Ser. No. 423,580, Sep. 27, 1982, abandoned.

[30] Foreign Application Priority Data

Dec. 11, 1981 [DE] Fed. Rep. of Germany ..... 3149096

[51] Int. Cl.[3] ..... F02M 51/00

[52] U.S. Cl. ..... 123/489; 123/440

[58] Field of Search ..... 123/489, 440

[56] References Cited

U.S. PATENT DOCUMENTS

| | | | |
|---|---|---|---|
| 4,131,091 | 12/1978 | Asano et al. | 123/489 |
| 4,163,433 | 8/1979 | Fujishiro | 123/489 |
| 4,174,680 | 11/1979 | Anzai | 123/489 |
| 4,210,106 | 7/1980 | Wessel et al. | 123/489 |
| 4,228,775 | 10/1980 | Schweikert | 123/440 |
| 4,300,505 | 11/1981 | Takada et al. | 123/489 |
| 4,345,560 | 8/1982 | Nakamura et al. | 123/440 |
| 4,402,291 | 9/1983 | Aono | 123/489 |

*Primary Examiner*—Parshotam S. Lall
*Attorney, Agent, or Firm*—Edwin E. Greigg

[57] ABSTRACT

A method and an apparatus for lambda regulation are proposed which provide an optimizing of the integrator inclination in accordance with the time elapsed following a switching process of the lambda sensor. The processable time can adjust itself to the rpm of the internal combustion engine. Minimum and maximum values, at least, of the integrator inclination are efficaciously dependent on rmp and/or load. It is furthermore provided that fuel quantity values be determined during quasi-stationary operating states via an average-value formation of minimum and maximum correction values. In addition to a possible hardware realization, a computer realization having a learning regulation system is also proposed.

14 Claims, 7 Drawing Figures

METHOD AND APPARATUS FOR LAMBDA REGULATION IN AN INTERNAL COMBUSTION ENGINE

This is a continuation of copending application Ser. No. 423,580 filed Sept. 27, 1982, now abandoned.

BACKGROUND OF THE INVENTION

In many countries, because of relatively stringent requirements for exhaust gas composition, lambda regulation in internal combustion engines of motor vehicles is already standard equipment. The lambda regulation functions with an exhaust gas sensor which switches over, that, is changes between limiting values at a mixture where lambda=1; for example, each time the sensor voltage goes through a zero value, the integration direction of the integrating controller changes, which causes lambda to be always controlled in the direction of $\lambda=1$. In order to obtain these switching processes, the mixture is continuously enriched and leaned down again. Since necessarily there is a period of time before the sensor reacts to a change in mixture composition, undesirable peaks in exhaust gas values are continuously produced. If a slight enrichment is selected, then it may under some circumstances take a while until the next switchover point has again been attained. In the opposite instance, that is, if heavy enrichment is provided, then because of the transit time "overswings" or oscillations of the mixture and exhaust gas occur, thus producing such exhaust gas peaks.

A lambda regulation device disclosed in U.S. Pat. No. 3,782,347 detects the period of time between two switchover processes and after a predetermined interval of time has elapsed in which no switchover process occurs, then a switchover is made to a different, shorter time constant in the regulating amplifier. As a consequence of this, an amplified change in the mixture occurs after this predetermined period of time has elapsed, which in turn causes a more rapid switching process. However, the danger then exists of a certain degree of overcontrol, producing undesirable exhaust gas emissions.

Although this known regulating device is generally capable of producing satisfactory results, still it does not attain an optimum in terms of clean exhaust gas, because of the exhaust gas peaks which necessarily occur.

OBJECT AND SUMMARY OF THE INVENTION

With the lambda regulation method according to the invention and the lambda regulation system provided for performing the method, an optimum in terms of the exhaust gas composition can be attained continuously, regardless of the operating status of the engine at a given time and regardless of whether stationary or unstationary operation is occurring.

The invention will be better understood and further objects and advantages thereof will become more apparent from the ensuing detailed description of preferred embodiments taken in conjunction with the drawings.

DESCRIPTION OF THE PREFERRED EMBODIMENTS

The following exemplary embodiments will be described in connection with an intermittently operating fuel injection system. However, the lambda regulation means per se is not dependent on the type of mixture metering, so that the invention can also be used, for instance, in carburetor systems.

Figure 1:
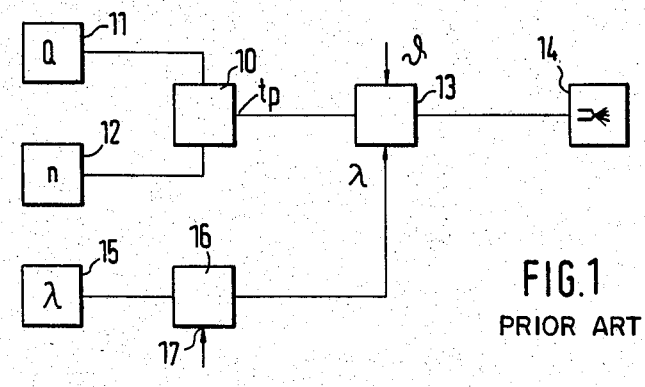
FIG.1 PRIOR ART
FIG. 1 is a rough block circuit diagram of the electrical portion of a fuel injection system in an internal combustion engine.

In FIG. 1, 10 represents a timing element which receives input signals from a load (Q) sensor 11 and from an rpm (n) sensor 12 and on its output side emits basic injection pulses of the duration $t_p$. A correction circuit 13 follows, in which the basic injection pulses are affected in accordance with the temperature of the internal combustion engine and in the manner associated with lambda regulation. These corrected pulses are finally delivered to at least one injection valve 14 in the vicinity of the intake tube of the engine.

A lambda sensor is indicated at 15. It emits its output signal to a lambda regulator 16, in which a lambda correction signal is formed, under the influence of further variables, via a control input 17; this correction signal serves in turn as the input signal of the correction circuit 13. The basic arrangement shown in FIG. 1 is known per se (see, for example, U.S. Pat. No. 4,275,695). A basic injection pulse is formed in accordance with a load and rpm signal, and the basic injection pulse is then corrected in accordance with further operating parameters of the engine and serves as a trigger variable for the electromagnetic injection valves.

Figure 2A:
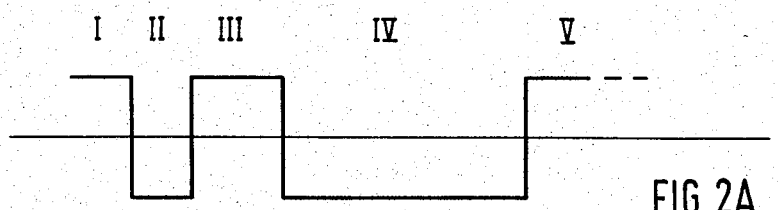
FIG. 2A shows the output signal of a lambda sensor with a varying mixture composition.
Figure 2B:
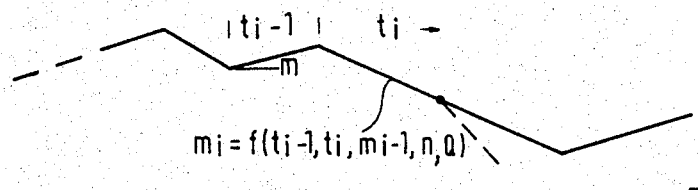
FIG. 2B shows the signal behavior of the integrator of the lambda regulation system.

FIGS. 2A and 2B illustrate the present invention. In FIG. 2A, the output signal of the lambda sensor 15 for varying mixture compositions is shown, and FIG. 2B shows the integrated output signal of the lambda regulating circuit 16 of FIG. 1. The integrator of this lambda regulating circuit 16 integrates upward or downward depending upon the algebraic sign of the potential of FIG. 2A, or in other words in accordance with whether a rich mixture or a lean mixture is present.

In the example shown in FIG. 2, the integrator integrates upward given a positive signal of the lambda sensor 15 and downward given a correspondingly negative signal. What is important is that the integrator inclination varies in accordance with conditions prevailing until the preceding switchover point of the sensor and/or subsequently as well. This is clearly expressed by the formula in FIG. 2B, according to which the inclination during the period of time II orients itself at least to the period of time and the inclination during the period of time I. In general terms, the result is $$m_i=f(t_{i-1},\ t_i m_{i-1},\ n,\ \dot{Q})$$

$t_{i-1}$=the total duration of the latest integration phase
$t_i$=duration since the last switchover process
m=integrator inclination $\dot{n}$=rpm
$\dot{Q}$=load In terms of the optimizing process, the dependencies relating to the inclination are selected such that the next subsequent inclination value is greater than the preceding value, the longer the preceding sensor potential remained at a constant value and the longer the period of time for which the constant output potential has prevailed. As a result, the I component of the regulator is continuously optimized, that is, enlarged or reduced up or down to a predetermined maximum or minimum value. In addition to the purely time-dependent value, an enlargement of the I component is also provided if no switching of the lambda sensor occurs within a predetermined number of crankshaft revolutions. The I component is reduced in size if switching does occur.

In addition, the inclination values may be varied in accordance with a load or rpm signal, in order to prevent instability of the regulator at threshold values, among other factors.

Figure 3:
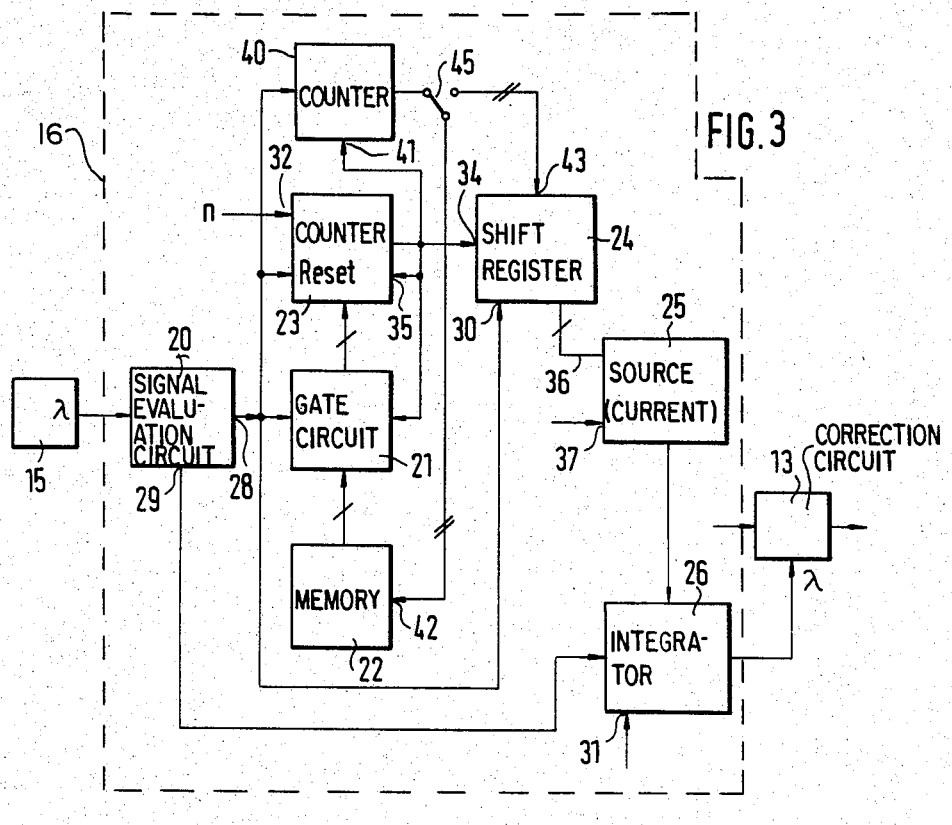
FIG. 3 is a block circuit diagram of a lambda regulating system for performing the method according to the invention.

A possibility for realizing the method according to the invention for lambda regulation in hardware terms is shown in FIG. 3. The lambda regulating circuit 16 of FIG. 1 is split apart in this case, and has the individual elements of a sensor signal evaluation circuit 20, a gate circuit 21, a memory 22, a counter 23, a shift register 24, a controlled current source 25, and an integrator 26. At a first output 28, the sensor signal evaluation circuit 20 emits a switching signal at all times, if a potential jump has occurred in the lambda sensor 15. The signal at the second output 29 of the sensor signal evaluation circuit 20 indicates whether the instantantaneous sensor signal is at high or low potential. While the output 28 is carried to the reset input of the counter 23, the switching input of the gate circuit 21 and a downward-direction input 30 of the shift register 24, the output 29 of the sensor signal evaluation circuit 20 is connected with an integration-direction control input of the integrator 26. This integrator 26 has an additional input 31, by way of which its instantaneous value can be fixed at a definite value.

One counting input 32 of the counter 23 receives a counting signal from the rpm sensor, not otherwise shown. On the output side the counter 23 is connected with an upward-direction control input 34 of the shift register 24, as well as with one input of the gate circuit 21 and with a transfer input 35 of the counter. The shift register 24 itself is coupled via a word line 36 with the following current source 25, which is controllable in accordance with load via a further input 37. In the example shown in FIG. 3, the current source 25 directly influences the inclination of the integrator 26, the output of which in turn is carried to the correction circuit 13.

A second counter is indicated at 40, which is likewise resettable by the signal of the output 28 of the sensor signal evaluation circuit 20 and which counts zero passages of the counter 23 as they occur. In this example under discussion, the output of the counter 23 is coupled directly with the counting input 41 of the counter 40. This counter 40, again in the example under discussion, is connected selectively with a control input 42 of the memory 22 and with a control input 43 of the shift register 24.

The function of the circuitry shown in FIG. 3 is as follows:

Upon each transition of the lambda sensor signal from 0 to 1 and vice versa, the output 28 of the sensor signal evaluation circuit 20 furnishes a pulse. This pulse controls the gate circuit 21 and the counter 23 in such a manner that the value stored in the memory 23 is transferred to the counter 23. Beginning with this value, the counter 23 counts downward upon each rpm pulse at the counting input 32.

If the counter 23 attains a zero counter state, then the shift register 24 is shifted into its next higher position. The gate circuit 21 and the counter 23 are furthermore controlled via the input 35 such that the value is again transferred from the memory 22 into the counter 23.

If a pulse appears at the output 28 of the sensor signal evaluation circuit 20 before the counter 23 has counted to zero, then the counter 23 is again charged with the value from the memory 22. The shift register 24 is furthermore shifted by one position in the downward direction.

The output signal of the shift register 24 controls the current source 25. The higher the position of the shift register 24, the higher the current in the current source 25 and thus the greater the inclination of the integrator signal.

As is conventional in lambda regulation, the integrator is switched upward or downward in an integrating fashion in accordance with the sensor voltage. A switchover of this integrator value to a fixed output value is possible via the specialized control input 31. This is effected for instance during the starting and warmup phase, as well as during acceleration and deceleration processes.

By means of the described manner of regulation of the integrator inclination, it is assured that the lambda regulator always functions with the smallest possible I component. On the other hand, it is assured that a large I component comes into play rapidly if large deviations must be compensated for. The range of the lambda regulation can thus be increased.

In a variation of the basic regulator principle, following the appearance of a pulse at the output 28 of the sensor signal evaluation circuit 20, counting is performed by means of the counter 40 as to how frequently the counter 23 has attained the zero position up until the next subsequent switching process of the sensor. In accordance with this counter result, an enlargement or reduction of the output value of the memory 22 is then effected.

On the other hand, it is also possible as indicated by means of a selective switch 45 for the shift register to be shifted to a greater or lesser extent depending upon the number of zero passages of the counter 23, with the result that direct influence is exerted on the controllable current source 25 and thus on the inclination of the integrator signal.

Although FIG. 3 illustrates a hardware type of realization which is possible for performing the method according to the invention, realization by means of a freely programmable computer is equally unproblematical because the invention as such is clearly recognizable, and either a hardware realization or realization by means of programs is readily attainable by one skilled in the art of computers.

The lambda regulation described in detail above, having a superimposed regulation of the I component, has already proved itself to be extremely satisfactory when used alone. Combinations with a lambda regulation in quasi-stationary operating points will now be discussed. The basic concept here is to manipulate the lambda regulation differently for stationary and non-stationary operating states, and if a quasi-stationary state continues to prevail, then a transition is made from closed-loop control to open-loop control. Because of the complexity of this subject, a computer-controlled realization will tend to be selected, such a realization being equally unproblematical.

Figure 4:
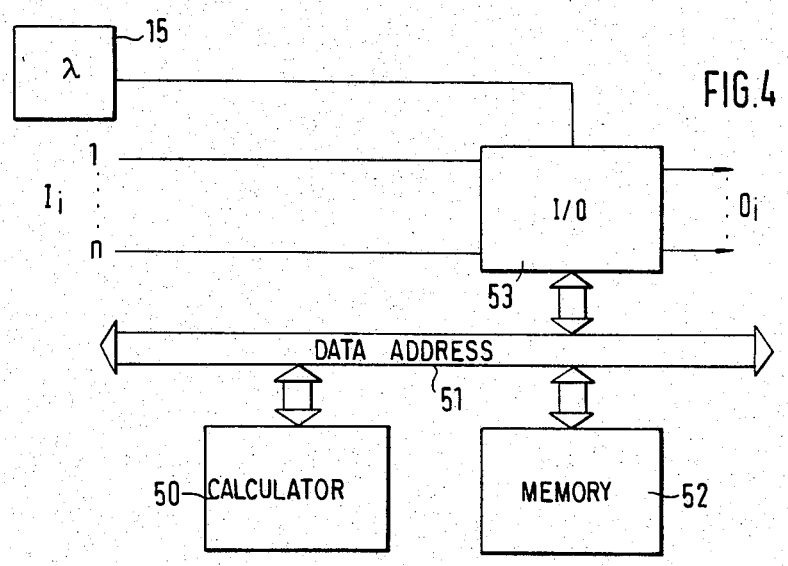
FIG. 4 is a rough overview of a lambda regulation means having a microcomputer.

FIG. 4 in a rough overview shows a computer-controlled system having the most important components. Reference numeral 50 indicates a calculator unit which is coupled via a data, control and address bus 51 with a memory 52 and with an input/output unit 53. This last block 53 receives various input variables $I_i$ in addition to a signal from the lambda sensor 15 and emits various output variables $O_i$, for instance an injection time and an error signal.

Figure 5:
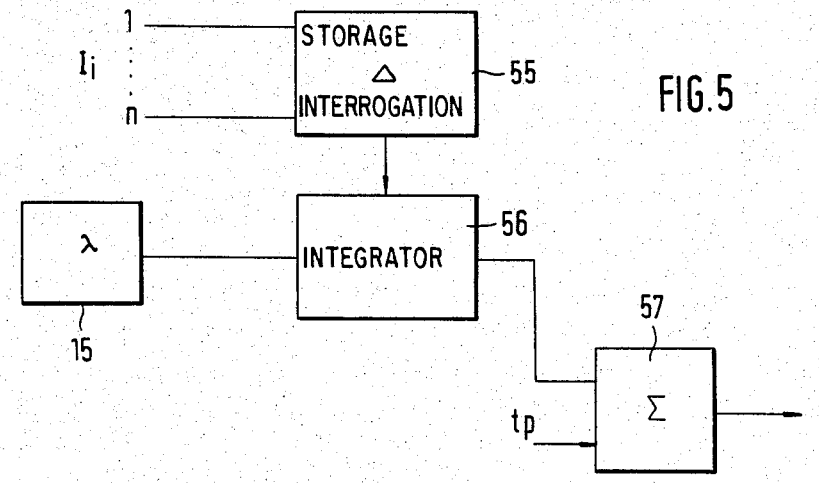
FIG. 5 shows the block structure of the lambda regulator.

FIG. 5 shows a block structure for the lambda regulator when realization is by means of a computer. The input variables $I_i$ here reach a Δ interrogation unit 55, which like a lambda sensor 15 is coupled with an integrator 56. On the output side, the integrator, as in the basic block circuit diagram of a fuel injection system shown in FIG. 1, is connected with a summing member (element 57 in FIG. 5).

In the Δ interrogation unit 55, at the onset of a quasi-stationary range, the values of the input variables $I_i$ such as rpm n, air mass Q, or the engine temperature T are stored. In addition, variables which are derived from input variables in the control unit can be used as input signals.

As soon as the deviation for one of these variables exceeds a predetermined value, then a switchover is effected in the unit 55, so that the particular values for the variables $I_i$ prevailing at a given time are transferred to the corresponding memory. At the output of the Δ interrogation unit 55, the signal for non-stationary operation then appears. The particular values $I_i(t_n)$ prevailing at a given time are now compared at each instant of interrogation with the values $I_i(t_n-1)$ of the preceding interrogation instant. If the deviations are again smaller than given values for $\Delta I_i$, then the signal for quasi-stationary operation again appears at the output of the unit 55, and the most recent lambda value is then retained.

Figure 6:
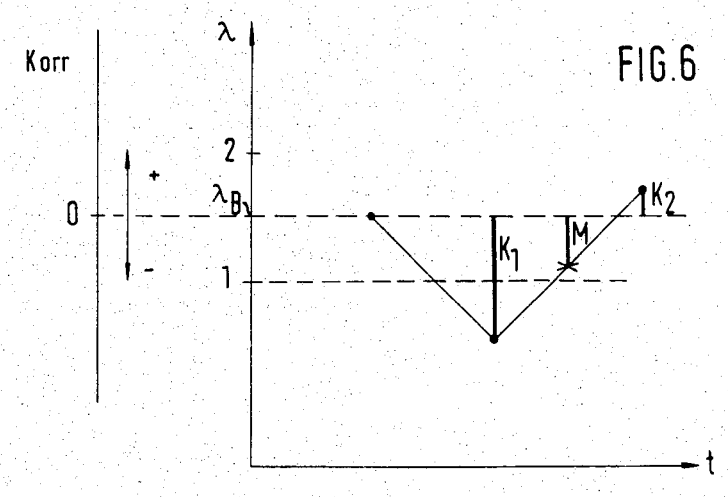
FIG. 6 is an illustration for forming average values of selected lambda regulation values.

In various systems, an average-value formation has also proved to be efficacious, functioning as shown in FIG. 6. FIG. 6 shows various lambda values plotted over time, specifically lambda values which were ascertained at specific instants, and are averaged for the purpose of effecting the most precise possible control. This average-value formation adjusts itself, for instance, to two correction values $K_1$ and $K_2$. While the value $K_1$ characterized the deviation of the stored value at the operating point in question from the minimum value, the correction value $K_2$ indicates the deviation from the maximum value. The ascertained average value M then represents the lambda value which serves as a new control value for the lambda regulation.

In other words, as soon as the lambda regulation described at the outset above has attained the least integrator inclination, then as shown in FIG. 6 a storage of the correction values ($K_1$, $K_2$) is performed at the two switchover points of the regulator. The average values M of the particular associated minimal ($K_1$) and maximal ($K_2$) values are formed and the regulator is switched off. Naturally, this average-value formation can also be effected via more than two correction values or again, may itself be based on average values.

The average value formed in this manner represents the correction value for lambda=1. In the calculator element 50, the total value is ascertained from this correction value and from the basic value stored in the memory 52, the total value corresponding to the corrected fuel quantity for lambda=1. If lambda values not equal to 1 are desired, then this value is accordingly multiplied with the desired lambda value for the particular operating point in question. This multiplied value then determines the fuel quantity. In this manner an arbitrary lambda value can be associated with each operating point.

If the characteristic curves for the various functions such as starting enrichment, warmup enrichment, etc. are stored in digital form, then the following variant makes possible a correction of the characteristic curves stored in memory.

If values only for $\lambda=1$ are to be corrected, then the average-value formation is effected as described above. Without switching the regulator off, the stored characteristic curve value is then corrected with the aid of the thus-ascertained correction value, and the corrected value is stored in the sense of a "learning" system.

If values for lambda not equal to one are to be corrected, then again after the obtention of the least possible integrator inclination, an average-value formation is performed, the regulator is shut off, and the desired total value is calculated as described above, corresponding to the corrected fuel quantity for the desired lambda value. This value is then stored in memory instead of the previous value for this operating point. This total value also serves to control the fuel quantity until the corresponding interrogation again recognizes unsteady or unstationary operation. The fuel quantity is determined by the stored values for the various operational points. If the Δ interrogation 55 switches back to stationary operation, then the lambda regulation is reactivated based on an integrator value of zero as well as on a fixed inclination value. Based on this, the inclination of the integrator is then optimized in the sense of the regulation concept discussed at the outset above. If it has attained the smallest possible value, then a corrective-value formation is again effected and the stored fuel quantity value is corrected for the corresponding operational point. The above-described lambda regulating devices are characterized by their flexibility in the lambda regulation process, based on a variable integrator inclination with continuous optimizing of this inclination value and with the rapid regulation associated therewith to the desired value.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A method for lambda regulation in a lambda regulator of an internal combustion engine having an integrator in which the regulating data is controlled between at least two switchover periods of a lambda sensor in accordance with operating parameters such as load, rpm and time, comprising the steps of, continuously optimizing the integrator slope of the lambda regulator according to at least a time-dependent function wherein the integrator slope is dependent upon at least one of an integrator slope during a previous switchover period prior to the last switchover period of said lambda sensor and the time period of a previously elapsed switchover period prior to the last switchover period of said lambda sensor, and switching over said integrator.

2. A method as defined by claim 1, wherein the integrator inclination is varied after the elapse of a predetermined period of time following one switching process of the sensor.

3. A method as defined by claim 1, wherein the period of time depends on a predetermined number of revolutions of the engine.

4. A method as defined by claim 1, further comprising the steps of, forming an average-value formation of correction values following the attainment of the least integrator inclination.

5. A method as defined by claim 4, further comprising the step of shutting off the lambda regulation following the attainment of the minimum permissible integrator inclination, whereby the control value adjusts itself to at least one of the average value and a value derived therefrom.

6. A method as defined by claim 5 wherein said corrected characteristic curve values are stored for use with a learning regulating system.

7. A method as defined by claim 4, wherein by means of the averaged correction values engine operating characteristic curve values are additively corrected.

8. A method as defined by claim 4, wherein by means of the averaged correction values engine operating characteristic curve values are multiplicatively corrected.

9. A method as defined by claim 8 wherein said corrected characteristic curve values are stored for use with a learning regulating system.

10. A lambda regulator having an integrator for performing the lambda regulation in an internal combustion engine having a fuel metering system which can be controlled electrically and sensors at least for the load, rpm and exhaust gas compostion, comprising, a sensor-signal evaluation circuit means responsive to an exhaust gas sensor;

means for detecting the period of time of at least one of: the time period following one switching process of said exhaust gas sensor and the time period between sequential switchover periods of said exhaust gas sensor prior to the last switchover period of said exhaust gas sensor, and means for controlling in accordance with at least one of the duration of said time period and the I component during a previous switchover period prior to the last switchover period of said exhaust gas sensor the I component of the lambda regulator.

11. An apparatus as defined by claim 10 further comprising, integrator means for increasing the integration constant of said lambda regulator with increasing duration of said period of time following a sensor signal change.

12. An apparatus as defined by claim 11, wherein the detecting means comprises a means for storing correction values and a means for counting said values, whereby the number of said values determines the integrator slope.

13. An apparatus as defined by claim 12, wherein initial values of said counting values are variable.

14. An apparatus as defined by claim 12, wherein said means for storing values forms the average values between minimum and maximum correction values, whereby the average values control in quasi-stationary operating states.

* * * * *